US005634890A

United States Patent [19]

Morris

[11] Patent Number: 5,634,890

[45] Date of Patent: Jun. 3, 1997

[54] WATER MASSAGE THERAPY DEVICE AND METHOD FOR USING THE SAME

[75] Inventor: Richard S. Morris, Lake George, N.Y.

[73] Assignee: Aquasage, Inc., Lake George, N.Y.

[21] Appl. No.: 436,179

[22] Filed: May 9, 1995

[51] Int. Cl.[6] ..... A61H 7/00

[52] U.S. Cl. ..... 601/166; 601/160; 601/159; 601/155

[58] Field of Search ..... 601/150, 151, 601/152, 154, 155, 160, 166, 159

[56] References Cited

U.S. PATENT DOCUMENTS 3,088,459 5/1963 Rabinoff .
3,378,004 4/1968 Claycomb et al. .
3,477,424 11/1969 Tracy .
3,478,738 11/1969 Altman et al. .
3,840,019 10/1974 Smirnov et al. .
3,905,367 9/1975 Dapcich .
4,114,620 9/1978 Moore et al. .
4,335,726 6/1982 Kolstedt .
4,353,359 10/1982 Milbauer .
4,402,331 9/1983 Taldo et al. .
4,590,925 5/1986 Dillon .
4,718,429 1/1988 Smidt .
5,174,285 12/1992 Fontenot .
5,184,612 2/1993 Augustine .
5,190,032 3/1993 Zacot .
5,230,335 7/1993 Johnson, Jr. et al. .
5,261,399 11/1993 Klatz et al. .
5,263,336 11/1993 Kuramarohit .
5,277,695 1/1994 Johnson, Jr. et al. .
5,300,103 4/1994 Stemple et al. .

*Primary Examiner*—Robert A. Hafer
*Assistant Examiner*—Benjamin K. Koo
*Attorney, Agent, or Firm*—Hill, Steadman & Simpson

[57] ABSTRACT

A water-massaging device provides fluid jet-like action against a body portion of an individual or animal. A flexible manifold peripherally borders a separate fluid channel. The manifold and the fluid channel each connect to a fluid source with respective flexible tubings such that the fluid inflates the device in a secured position about a particular body portion. The channel has arranged thereon a plurality of apertures facing the body portion such that the fluid flowing through the channel penetrates through the apertures to provide massaging and/or therapeutic benefits to the body. The device provides adjustable hot or cold stimulation of the body for increasing circulation or reduction of swelling as well as other therapeutic benefits. Furthermore, an adjustable fluid outlet of the manifold provides adjustable stiffness of the manifold against the body portion.

20 Claims, 3 Drawing Sheets

WATER MASSAGE THERAPY DEVICE AND METHOD FOR USING THE SAME

BACKGROUND OF THE INVENTION

The present invention generally relates to a massaging unit for attachment to a water source to provide hydromassaging therapy. More specifically, the invention relates to a wrap for securing around a joint or other portion of a body for providing a water jet massaging action to the body area.

Generally, treatments are used to expedite the healing of an injury. Many different methods are known for treating the body by increasing the blood flow rate to specific areas of the body to accelerate the healing process. For instance, by applying heat treatments to localized areas of the body, the body may respond by increasing the blood flow rate to the localized area and provide a means for healing injuries and bruises to muscles and joints at the area.

Prior art devices are known such as U.S. Pat. Nos. 1,775,442; 3,378,004; 3,477,424; 3,840,019; 3,905,367; 4,098,279; 4,114,620; 4,149,529; 4,590,925; 4,718,429; 4,753,241; 5,184,612 and 5,190,032. These known devices provide heating or cooling treatment to areas of the body for promoting the circulation of blood and reduction of swelling or circulating hot or cold water through a membrane for hydrotherapy or cooling of a limb or other body member using circulated fluids.

The prior art devices are sometimes difficult to securely position on a body part to be treated. Furthermore, prior art devices fail to utilize the benefits of a water jet action on the skin of a specific body part. For example, in some known devices, a water permeable membrane is substantially in contact with a skin area being treated, as disclosed in U.S. Pat. No. 3,905,367. Other devices, such as that in U.S. Pat. No. 3,477,424, simply provide an enclosed waterflow over skin.

Therefore, a need exists for an improved hydrotherapy device which provides secure positioning around a body member and which provides improved hydromassaging action in a variable hot to cold pressurized fluid application.

SUMMARY OF THE INVENTION

The present invention provides a system and a method for improved localized hydrotherapy as used in healing processes from injuries or the like to the body of an individual. To this end, the invention provides an apparatus for connecting a flexible member with a flexible tubing to be connected to a fluid supply, such as a shower head.

In an embodiment, the invention provides an apparatus connected to a fluid supply and having a flexible member secured about a portion of the body of an individual. The flexible member includes a fluid channel and a manifold disposed peripherally around a border of the fluid channel. The fluid channel contains a plurality of apertures. A first fluid inlet port receives fluid from the fluid supply into the manifold. A second fluid inlet port receives fluid into the fluid channel. Furthermore, a means is provided for securing the apparatus about the body portion such that the plurality of apertures face the body portion to direct the fluid through the apertures to contact the body portion.

In an embodiment, the fluid channel is serpentine in shape.

In an embodiment, the means for securing is a belt securable between opposite ends of the flexible member to pull the opposite ends together. In a related embodiment, the belt is securable by a hook-and-loop type fastener.

In an embodiment, an adjustable fluid outlet is provided for relieving a flow of fluid from the manifold.

In an embodiment, a first connector is provided for connecting the first and second inlet ports to the fluid supply wherein the first connector includes a diverter for altering the direction of the fluid supply.

In an embodiment, the apertures are premanufactured to angularly direct the fluid in a desired direction.

In an embodiment, a reservoir is connected between the fluid supply and the fluid channel inlet port for providing a second solution from the reservoir to the fluid.

In an embodiment, the manifold has a larger diameter than the fluid channel so that the manifold inflates with the fluid to substantially hold the fluid channel away from contact with the body portion to enhance the massaging effect.

In an embodiment, the fluid supply is a shower head. In another embodiment, the fluid supply is a faucet.

The present invention also includes a method for massaging an area of the body. A flexible member having impermeable inner and outer layers is attached to a fluid source. The flexible member has separate manifold and fluid channel portions wherein the inner layer has a plurality of apertures at the fluid channel portion. The flexible member is secured about the area of the body so that the plurality of apertures is directed toward the area of the body. The fluid source is activated to force the fluid therefrom to inflate the manifold and to penetrate through the plurality of apertures in the fluid channel.

In an embodiment, a solution is supplied to the fluid before the fluid enters the flexible member.

The fluid is drained from the manifold through an adjustable outlet to control a contact pressure of the manifold against the body.

It is, therefore, an advantage of the present invention to provide an improved water massage treatment device and method for massaging.

Another advantage of the present invention is to provide a device that can be secured in various positions of a body for treatment of different body areas.

A further advantage of the present invention is to provide a device which is adjustable to control the tightness of contact with the body.

An additional advantage of the present invention is to provide a water massage therapy device which can provide a treatment at a selected temperature.

A still further advantage of the present invention is to provide a device which can conveniently be connected to a water source such as a shower head or faucet.

Yet another advantage of the present invention is to provide a device that directs water jets in particular directions.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 8:
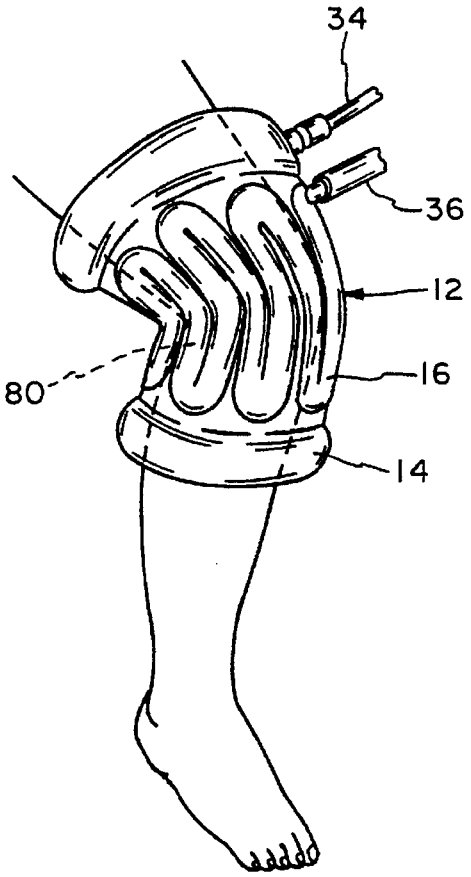
FIG. 8 illustrates a perspective view of the apparatus as used around a knee joint of an individual.
Figure 9:
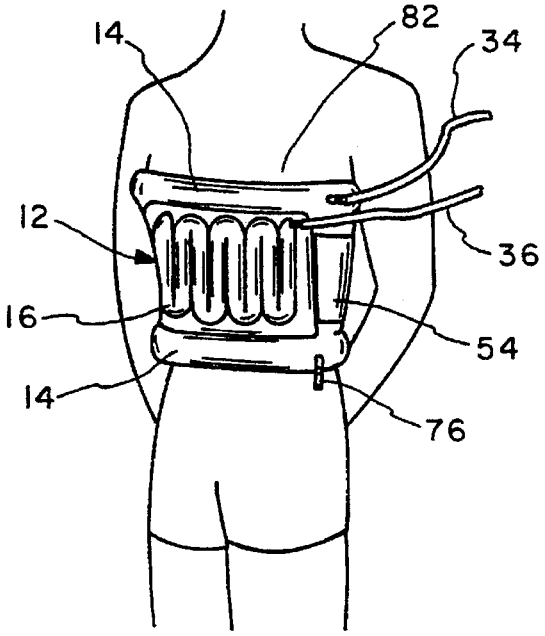
FIG. 9 illustrates a perspective view of the apparatus as used around a torso of an individual.

In accordance with the invention, a system is provided for providing localized hydrotherapy, preferably for an area of the body of an individual or animal, wherein the apparatus and method may be used about an area of the body requiring treatment. Such a system is illustrated in FIGS. 1, 8 and 9.

Figure 1:
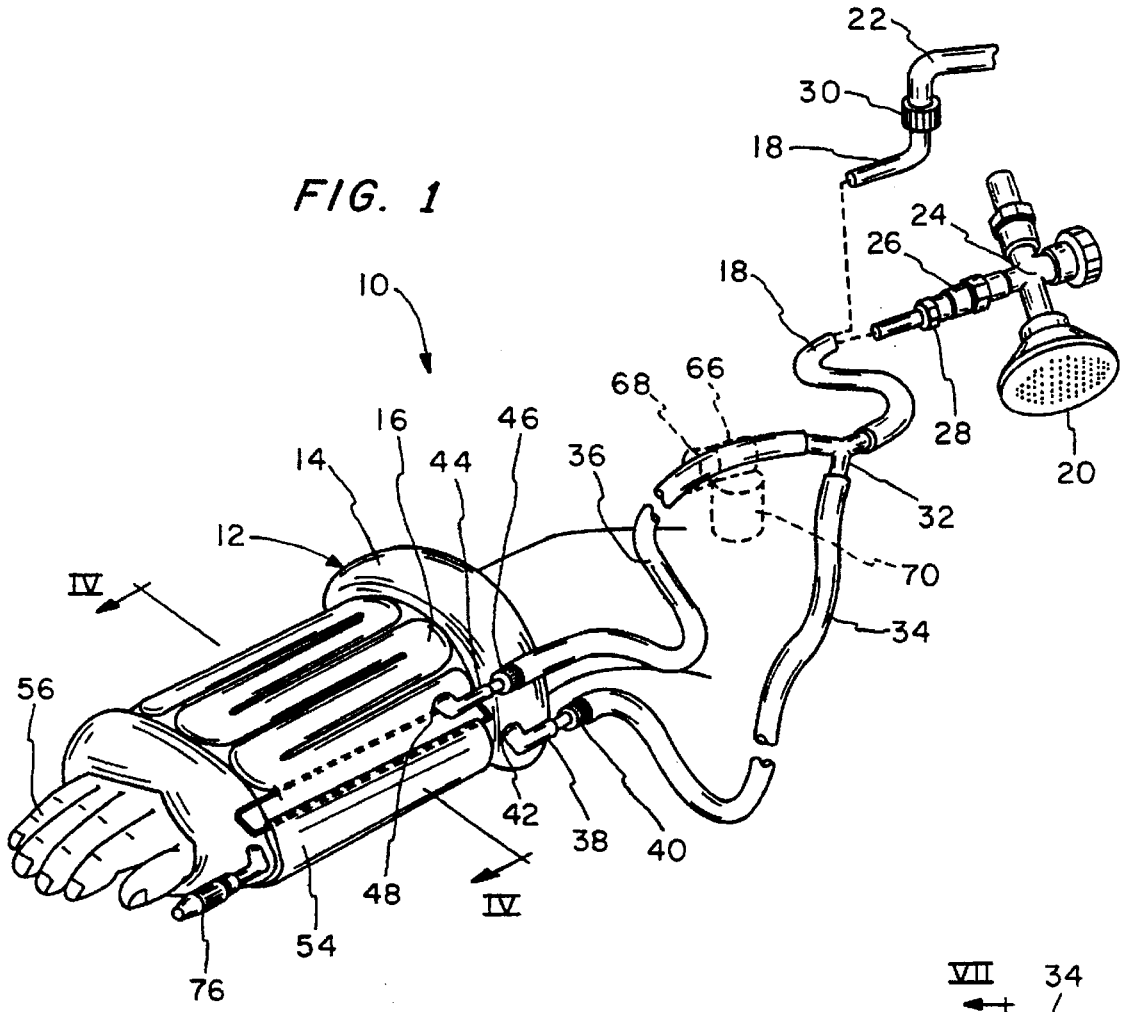
FIG. 1 illustrates a perspective view of an embodiment of the apparatus of the present invention as shown wrapped around the arm of an individual.

A system 10 is generally shown in FIG. 1 including a flexible member 12. The flexible member 12 has a manifold 14 and a fluid channel 16. The flexible member 12 is configured to receive fluid from a fluid supply. The system 10 also includes a first flexible tubing 18 connected to the fluid supply, such as a conventional shower head 20 or a conventional faucet 22.

An embodiment of the present invention includes a diverter valve 24 situated to divert the stream of water approaching the shower head 20 to the first flexible tubing 18 instead of entering the shower head 20. A male connector 26 at the output of the diverter valve 24 is directed to a female connector 28 fitted to an end of the first flexible tubing 18. This provides a quick connect and disconnect arrangement between the diverter valve 24 connected to the shower head 20 and the first flexible tubing 18 of the system 10. As will be understood by those skilled in the art, any suitable quick connect/disconnect may be used which provides a sealed relationship between the diverter valve 24 and the tubing 18.

Another embodiment includes a threaded ring connector 30 configured to fit onto the faucet 22. A conventional faucet 22 generally has a threaded portion which can accommodate such a connection. A faucet 22 commonly is fitted with an aerator (not shown) which must be removed to access the threaded portion. The threaded ring connector 30 is connected to the first flexible tubing 18 to provide sealed communication from the faucet 22 to the first flexible tubing 18.

The first flexible tubing 18 connects to a Y-connector 32 which splits the stream of water into a second flexible tubing 34 and a third flexible tubing 36. A female connector 38 at the opposite end of the second flexible tubing 34 connects to a male connector 40 at a manifold inlet port 42. Similarly, a female connector 44 at the opposite end of the third flexible tubing 36 connects to a male connector 46 at a fluid channel inlet port 48.

Figure 2:
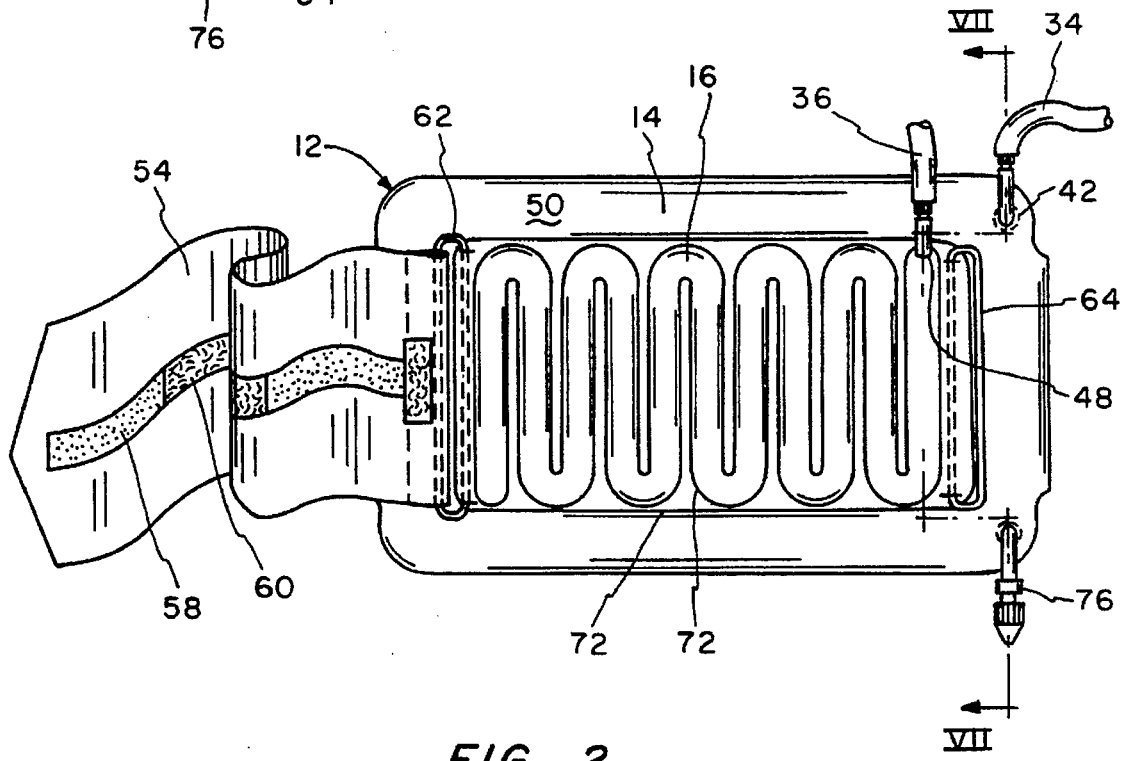
FIG. 2 illustrates an outer plan view of an embodiment of the apparatus of the present invention.

As illustrated in both FIGS. 1 and 2, the manifold inlet port 42 receives the fluid supply transferred in the second flexible tubing 34 into the manifold 14 of the flexible member 12. The fluid channel inlet port 48 receives the fluid supply transferred in the third flexible tubing 36 into the fluid channel 16 of the flexible member 12.

The flexible member 12 is formed from an outer layer 50 (FIG. 2) and an inner layer 52 (FIG. 3) bonded together along specific portions using a conventional sealing technique, such as RF welding. Both the outer layer 50 and the inner layer 52 are made of a flexible, impermeable sheet material, such as a high-grade plastic fabric. The inner and outer layers 50, 52 are pre-cut from the sheets and RF welded together to form the flexible member 12. The wall thicknesses of the impermeable material may vary from between approximately 20 mil and 30 mil depending on the particular application and anticipated usages.

As shown in FIG. 1, the system 10 includes a belt 54 which secures the flexible member 12 about a lower arm 56 of an individual. Referring to FIG. 2, the belt 54 may be covered with sections of Velcro®-type material. Accordingly, hook patches 58 and loop patches 60 are positioned to respectively contact each other when the belt 54 is overlapped. The belt 54 is secured to the flexible member 12 by an elongated first wire loop 62. An elongated second wire loop 64 is secured to an opposite end of the flexible member 12. The first and second wire loops 62 and 64, respectively, are each secured to the flexible member 12 by portions passed between the inner layer 52 and outer layer 50 in a passage created by bonding. This passage is between the fluid channel 16 and the manifold 14.

To retain the flexible member 12 in a desired position around a body part, the belt 54 is passed through the second wire loop 64 and overlapped on itself. This pulls the opposite ends of the member 12 together. The hook patches 58 and loop patches 60 are positioned to form a secure contact on the facing portions of the overlapping belt 54.

In an alternative embodiment, a second belt (not shown) is secured onto the second wire loop in a similar fashion. The flexible member 12 is positionable on a body member, and the two belts can be overlapped on each other, securing together with cooperative hook and loop patches. Each belt would pull its respective end of the flexible member 12.

Referring back to FIG. 1, a Venturi valve 66 and connector 68 may be included along the third flexible tubing 36 and further attached to a solution holder 70. As a result, a mixture of a solution, such as an antiseptic, from the holder 70 and the fluid flowing through the third flexible tubing 36 may be mixed as desired for topical application to a body surface in the form of a mixture.

FIG. 2 shows the flexible member 12 as shown in FIG. 1 laying in a flat, unfastened position with the outer layer 50 facing upward. The manifold inlet port 42 receives the fluid flowing through the second flexible tubing 34 so as to flow into the manifold 14 formed in the flexible member 12. The manifold 14 is generally disposed around a periphery of the flexible member 12. The fluid channel 16 is formed in the flexible member 12 within the area bounded by the manifold 14. The fluid channel 16 is separated from the manifold 14 by sealed lines 72.

The fluid channel 16 has a serpentine shape, winding to substantially fill the area bordered by the manifold 14. It should be understood that the fluid channel 16 could be arranged in some shape other than that illustrated.

Fluid flowing through the manifold inlet port 42 is forced to fill the entire volume of the manifold 14. Similarly, fluid flowing through the fluid channel inlet port 48 is forced to fill the fluid channel 16. As a result, the fluid flows into the member 12 and fills the manifold 14 such that when the member 12 is secured about a limb or other body portion of an individual, such as is shown in FIG. 1, the manifold 14 expands to secure the member 12 about the body portion of the individual. This is further illustrated in FIGS. 7, 8 and 9.

Figure 3:
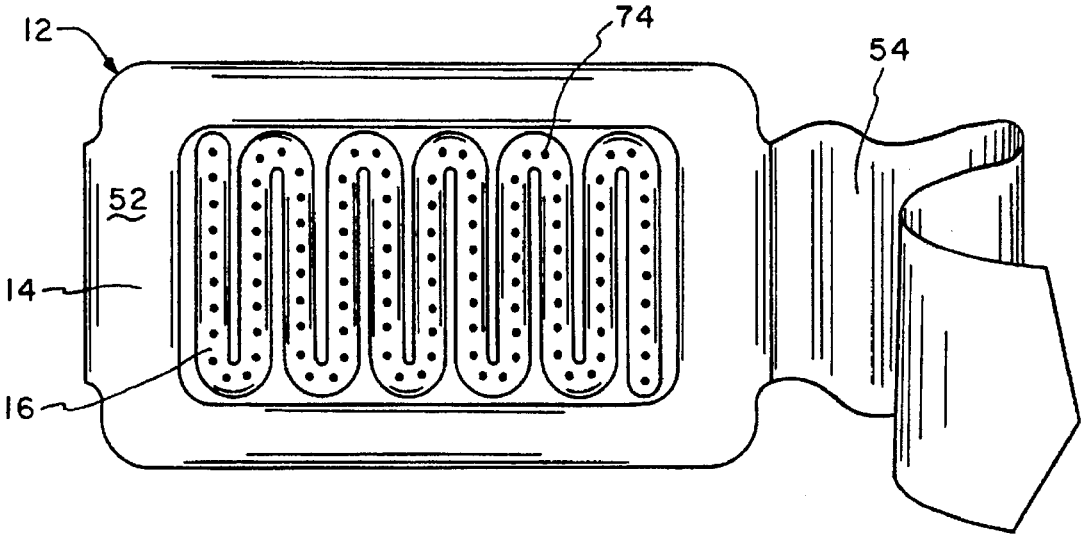
FIG. 3 illustrates an inner plan view of an embodiment of the apparatus as shown in FIG. 2.

FIG. 3 shows the flexible member 12 as shown in FIG. 2 from the opposite side, showing the inner layer 52. Along the fluid channel 16, a series of apertures 74 are located in the inner layer 52. During operation, pressurized fluid flowing through the channel 16 is forced to penetrate through the apertures 74 to contact the body. Although the apertures 74 are shown in a substantially straight alignment, it is understood that the apertures 74 may be offset as desired along the fluid channel 16.

The apertures 74 may vary in diameter, but are typically needle-sized. Apertures 74 of approximately 1/150" may be used to create a misting effect for treating burns with or without a medicinal solution from the Venturi valve attachments. The size of the apertures 74 may further vary based on the available fluid pressure. For a standard household shower hook-up, the available fluid pressure is approximately 50 psi, and, therefore, the size of apertures 74 may be approximately manufactured for household uses in mind.

In the embodiment illustrated, one fluid channel 16 is formed. The fluid entering the fluid channel 16 from the fluid channel inlet 48 circulates through the channel 16, ultimately exiting through the apertures 74 to massage the body portion wrapped within the flexible member 12. It should be understood, however, that more than one channel 16 together with an inlet port can be provided and that any number of apertures 74 may be included in a particular fluid channel 16.

Figure 4:
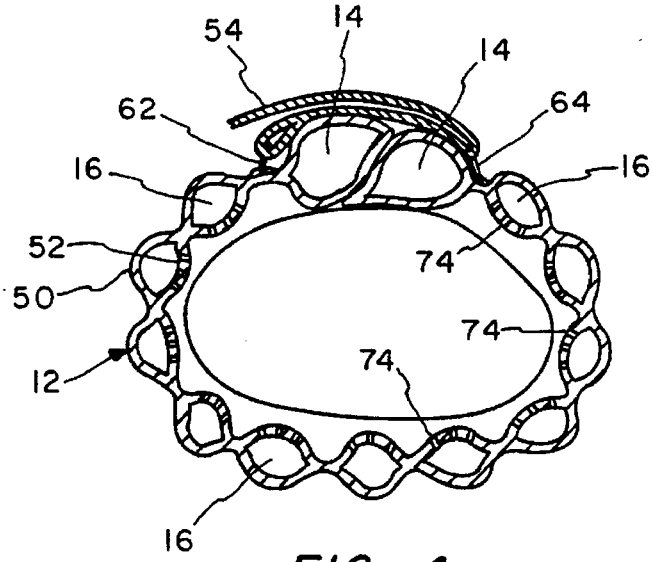
FIG. 4 illustrates a cross-sectional view of the apparatus of the present invention in a secured position taken generally along line IV—IV of FIG. 1.

FIG. 4 illustrates a cross-sectional view of the flexible member 12 when wrapped about the body portion of an individual. As can be seen, the belt 54 overlaps to secure the member 12 about a body portion. FIG. 4 further illustrates the fluid channel 16 and the manifold 14 in an inflated state.

When the member 12 is secured around the body portion of the individual and the fluid is flowing through the system, the manifold 14 defined by the inner wall 52 and the outer wall 50 inflates to a larger dimension than the fluid channel 16, as the diameter of the former is greater than the latter. This is so that the fluid channel 16 preferably does not contact the body of the individual, but is substantially held away therefrom. Therefore, the fluid penetrating through the apertures 74 results in water jet action against the body portion, and drainage of fluid through the fluid channel 16.

Because the water source can be a conventional shower head or faucet, the temperature can be easily controlled between hot and cold using the conventional valves (not shown) leading to such devices. This allows the system 10 to be used for various forms of treatment wherein a particular temperature is needed to obtain a particular therapeutic effect as well as allowing an individual to adapt temperatures of the fluid to the individual's tolerance level. Also, fluid pressure can also be adjusted with those conventional valves to control the penetrating force of the water jet action.

The manifold 14 can be drained through a fluid outlet 76. The fluid outlet 76 is variable so that the fluid pressure in the manifold 14 can be increased or decreased. By controlling the manifold pressure, the force of contact between the manifold 14 and a body portion can be set at a level required for proper positioning and comfort.

The apertures 74 may be situated in the fluid channel 16 to direct the water jets along a row which is substantially straight along the channel 16. The apertures 74 may be misaligned in their rows as illustrated in FIG. 4. This may be done to direct the apertures 74 in a given direction so that substantially all areas of the body may be sprayed by the fluid jet action through the apertures 74 on the surface of the body.

Figure 5:
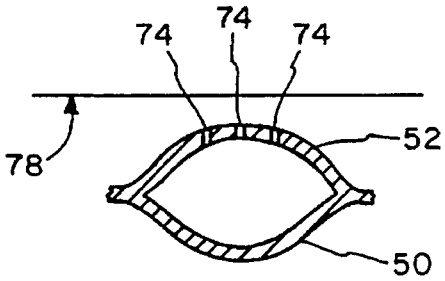
FIG. 5 illustrates a cross-sectional view of a single channel of the apparatus as shown in FIG. 4.
Figure 6:
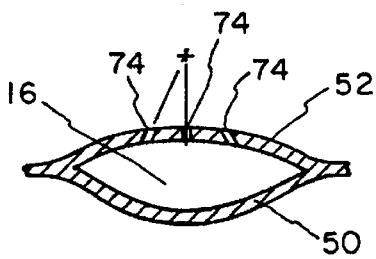
FIG. 6 illustrates an alternate embodiment of the single channel as shown in FIG. 5 having the apertures directed in a specific direction.

FIGS. 5 and 6 each illustrate a segment of the fluid channel 16 with non-aligned apertures 74. FIG. 5 illustrates the apertures 74 directed in a substantially perpendicular position in relation to inner wall 52 and outer wall 50 of the fluid channel 16 or in a substantially parallel relationship with respect to each other. FIG. 6 illustrates the apertures 74 angularly directed to focus the penetrating fluid at a specific point.

Figure 7:
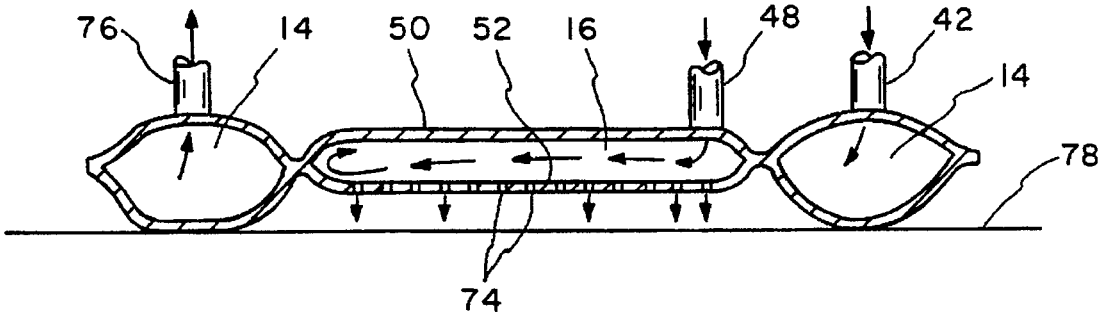
FIG. 7 illustrates a cross-sectional view taken generally along line VII—VII as shown in FIG. 2.

FIG. 7 is a cross-sectional view taken generally along line VII—VII of FIG. 2. The arrows indicate the direction of fluid flow entering the manifold from the manifold inlet port 42. The arrows also indicate the direction of fluid flow from the fluid channel inlet port 48 and through the inner layer 52 of the fluid channel 16. The fluid penetrates through the fluid channel 16 through the apertures 74.

Line 78 designates the surface of the body portion. As can be seen by FIG. 7, only the manifold 14 contacts the surface 78 of the body such that the fluid channel 16 does not contact the body portion surface 78. It is preferred that the fluid channel 16 be approximately ⅛" to ¼" from the body surface 78 when inflated, but other distances may be used depending on the desired application. Fluid jet action results between the surface 78 of the body and the inner wall 52 of the fluid channel 16 facing the body. FIGS. 8 and 9 illustrate various members 12 which may be used around various body parts. FIG. 8 shows the member 12 substantially as illustrated in FIGS. 2 and 3 secured about a knee joint 80 of an individual. FIG. 9 illustrates a member 12 substantially like that shown in FIGS. 2 and 3 but secured about a mid-section 82 of an individual.

As can be seen by FIGS. 1, 8, and 9, various sizes, shapes and configurations of the invention may be implemented depending on the particular application or portion of the body of a human or animal for which the system is used. In addition, although the invention has been described for fluid application, air or compressed gas may be desired and implemented for a particular application.

It should be understood that various changes and modifications to the presently preferred embodiments described herein will be apparent to those skilled in the art. Such changes and modifications can be made without departing from the spirit and scope of the present invention and without diminishing its attendant advantages. It is, therefore, intended that such changes and modifications be covered by the appended claims.

I claim:

1. An apparatus for connection to a fluid supply and securable about a body portion, the apparatus comprising:

a fluid channel containing a plurality of apertures;

a bladder disposed circumferentially around the fluid channel wherein the manifold has a cross-sectional diameter greater than a cross-sectional diameter of the fluid channel;

a first fluid inlet port mounted on the manifold adapted to receive fluid from the fluid supply into the bladder;

a second fluid inlet port mounted on the manifold adapted to receive the fluid into the fluid channel; and means for securing the apparatus about the body portion such that the plurality of apertures faces the body portion to direct the fluid through the plurality of apertures to contact the body portion.

2. The apparatus according to claim 1 wherein the fluid channel is serpentine in shape.

3. The apparatus according to claim 1 wherein the means for securing is a belt securable between opposite ends of the flexible member to pull the opposite ends together.

4. The apparatus according to claim 3 wherein the belt is securable by a hook-and-loop type fastener.

5. The apparatus according to claim 1 further comprising:

an adjustable fluid outlet relieving a flow of fluid from the manifold.

6. The apparatus according to claim 1 further comprising:

a first connector connecting the first fluid inlet and the second fluid inlet ports to the fluid supply wherein the first connector includes a diverter for altering the direction of the fluid supply.

7. The apparatus according to claim 1 wherein the apertures are premanufactured to direct the fluid in a desired direction.

8. The apparatus according to claim 1 further comprising:

a reservoir connected between the fluid supply and the inlet port, the reservoir providing a second solution from the reservoir to the fluid.

9. An apparatus for connection to a fluid supply and securable about a body portion, the apparatus comprising:

a flexible member having an impermeable outer layer secured to an impermeable inner layer forming an outer bladder circumferentially bordering a separate inner fluid channel, the inner layer having a plurality of apertures in the fluid channel wherein the outer manifold has a cross-sectional diameter greater than a cross-sectional diameter of the inner fluid channel;

a first fluid inlet port mounted on the outer manifold adapted to receive fluid from the fluid supply into the bladder;

a second fluid inlet port mounted on the inner fluid channel adapted to receive the fluid from the fluid supply into the fluid channel;

a fluid outlet relieving a flow of fluid from the bladder; and means for securing the flexible member about the body portion such that the inner layer faces the body portion to direct the fluid through the plurality of apertures to contact the body portion.

10. The apparatus according to claim 9 wherein the fluid channel is serpentine in shape.

11. The apparatus according to claim 9 wherein the means for securing is a belt securable between opposite ends of the flexible member to pull the opposite ends together.

12. The apparatus according to claim 9 further comprising:

an adjustable outlet controlling pressure inside the manifold.

13. The apparatus according to claim 9 wherein the manifold has a larger diameter than the fluid channel so that the manifold inflates with the fluid to substantially hold the fluid channel away from contact with the body portion.

14. The apparatus according to claim 9 wherein the fluid supply is a shower head, the apparatus further comprising:

a first connector connecting the tubing to the fluid supply wherein the first connector includes a diverter wherein the diverter alters the direction of the fluid supply.

15. The apparatus according to claim 9 wherein the fluid supply is a shower head.

16. The apparatus according to claim 9 wherein the fluid supply is a faucet.

17. The apparatus according to claim 9 wherein the fluid causes the manifold to inflate and contact the body portion to hold the flexible member in a substantially fixed position so that the channel is substantially separated from the body portion.

18. A method for massaging an area of the body, the method comprising the steps of:

attaching a flexible member having an impermeable inner layer and a circumferentially disposed impermeable outer layer to a fluid source, the flexible member having separate bladder and fluid channel portions for receiving fluid from the source through an inlet port mounted to each of the manifold and the fluid channel portion wherein the inner layer has a plurality of apertures therein at the fluid channel portion and further wherein the manifold has a cross-sectional diameter greater than a cross-sectional diameter of the fluid channel portion;

securing the flexible member about the area of the body such that the plurality of apertures is directed toward the area of the body; and activating the fluid source to force the fluid therefrom to inflate the bladder and to penetrate through the plurality of apertures in the fluid channel.

19. The method of claim 18 further comprising the step of:

supplying a solution to the fluid before the fluid enters the flexible member.

20. The method of claim 18 further comprising the step of:

draining the fluid from the manifold through an adjustable outlet to control a contact pressure of the manifold against the body.

* * * * *